US006389143B1

(12) United States Patent
Leedom et al.

(10) Patent No.: US 6,389,143 B1
(45) Date of Patent: May 14, 2002

(54) MODULAR ELECTROACOUSTIC INSTRUMENT

(75) Inventors: Marvin Allan Leedom, Princeton, NJ (US); Walter Paul Sjursen, Washington Crossing, PA (US)

(73) Assignee: Sarnoff Corporation, Princeton, NJ (US)

( * ) Notice: Subject to any disclaimer, the term of this patent is extended or adjusted under 35 U.S.C. 154(b) by 0 days.

(21) Appl. No.: 09/250,512

(22) Filed: Feb. 16, 1999

Related U.S. Application Data

(60) Provisional application No. 60/092,818, filed on Jul. 14, 1998.

(51) Int. Cl.[7] ..... H04R 25/00

(52) U.S. Cl. ..... 381/323; 381/322; 381/328; 181/130

(58) Field of Search ..... 381/60, 312, 322, 381/323, 324, 328, 380; 181/130, 135

(56) References Cited

U.S. PATENT DOCUMENTS

| | | | | |
|---|---|---|---|---|
| 2,959,645 A | | 11/1960 | Ladd | |
| 3,527,901 A | * | 9/1970 | Geib | 381/328 |
| 3,852,540 A | * | 12/1974 | Diethelm | 381/328 |
| 4,153,758 A | * | 5/1979 | Gerny | 381/323 |
| 4,532,649 A | * | 7/1985 | Bellafiore | 381/328 |
| 4,550,227 A | | 10/1985 | Topholm | |
| 4,672,672 A | * | 6/1987 | Eggert et al. | 381/328 |
| 5,187,746 A | | 2/1993 | Narisawa | |
| 5,195,139 A | * | 3/1993 | Gauthier | 381/328 |
| 5,701,348 A | * | 12/1997 | Shennib et al. | 381/328 |
| 5,724,431 A | * | 3/1998 | Reiter et al. | 381/323 |
| 5,889,874 A | * | 3/1999 | Schmitt et al. | 381/328 |
| 6,041,128 A | * | 3/2000 | Narisawa et al. | 381/322 |

FOREIGN PATENT DOCUMENTS

| | | |
|---|---|---|
| EP | 0 196 366 | 10/1986 |
| WO | WO 94 13116 | 6/1994 |

* cited by examiner

*Primary Examiner*—Curtis Kuntz
*Assistant Examiner*—Suhan Ni
(74) *Attorney, Agent, or Firm*—Hamilton, Brook, Smith & Reynolds, PC

(57) ABSTRACT

An electronic signal processing system, including a microphone section and an integral battery, may be assembled with a receiver section to form a three section hearing-aid. The shape of the outer shell of an integral battery may approximate the shape of an ear canal when attached to the other two sections. An integral (sealed-in) battery with such an unusual shape may have a higher capacity battery than those of standard insertable/removable batteries. The integral battery (e.g. a zinc-air battery) may be tested for leakage before being assembled to the other sections of the hearing-aid. To preserve battery shelf-life a "pull" tab may be placed over vents in the integral battery. To activate the battery, the "pull" tab may be removed. Conducting strips may be formed on the "pull" tab permitting the circuits, battery and components of the hearing-aid to be tested after assembly. In addition, a rotating microphone section-may be used to shift between audio modes of the signal processing circuitry.

3 Claims, 8 Drawing Sheets

MODULAR ELECTROACOUSTIC INSTRUMENT

This application claims the benefit of U.S. Provisional Application No. 60/092,818 filed Jul. 14, 1998.

FIELD OF THE INVENTION

The invention herein generally relates to a miniature electroacoustic instrument and, in particular, a modular hearing-aid instrument.

BACKGROUND OF THE INVENTION

Hearing instruments typically are custom-designed to suit the anatomical and audiological needs of an individual user. Because custom-made devices can be very costly, it is desirable to mass-produce a hearing instrument that is relatively inexpensive, readily adaptable to most users' anatomical and audiological requirements, and inconspicuous and lightweight. In addition, in order to mass-produce hearing instruments it is important to obtain a high manufacturing yield.

There are significant challenges associated with the development of mass-produced hearing instruments. Although the structure of the external auditory canal generally is a sinuous, oval cylinder with three sections, it varies significantly depending on the particular individual. Traversing the canal towards the tympanic membrane, the first section is directed inward, forward, and slightly upward. The next section tends to pass inward and backward. The final section is carried inward, forward, and slightly downward. The outer portion of the ear canal is surrounded by cartilaginous tissue, with the inner portion being surrounded by bone. The canal is lined by a very thin lining of skin, which is extremely sensitive to the presence foreign objects. Further details of the path and contours of the external auditory canal are described in U.S. Pat. No. 4,870,688, issued to Barry Voroba et al., and in U.S. Pat. No. 5,701,348, issued to Adnan Shennib, both of which are incorporated herein by reference.

U.S. Pat. 4,870,688 describes an in-the-canal miniaturized hearing-aid contained within a prefabricated earshell assembly composed of a hollow rigid body with a soft, resilient covering fixed to its exterior. The microphone, receiver, amplifier, and battery are all wholly contained within a prefabricated modular sound assembly which snaps into a patient-selectable prefabricated earshell assembly. The soft, resilient covering that is affixed to the exterior of the rigid core is intended to allow the cylindrical or elliptical shape of the in-the-canal hearing-aid to more easily conform to the individual variations in a user's auditory canal.

U.S. Pat. No. 5,701,348 describes a hearing device having highly articulated, non-contiguous parts including a receiver module for delivering acoustic signals, a main module containing all of the hearing-aid components except the receiver, and a connector that is articulated with both the receiver module and the main module to permit independent movement of the receiver and main modules. Separation of the receiver from the main module, and the receiver's articulation with respect to the main module, is intended to provide at least two degrees of freedom in movement and independent movement of the receiver module with respect to the main module, and vice versa.

Attempts have also been made to provide inserts intended to be used as a part of a hearing-aid device. U.S. Pat. No. 2,487,038, issued to Jasper Baum, describes an ear insert shaped for insertion into the concha or the outer cavity of an ear. It includes a series of ball-shaped ball-like wall sections each made with sufficiently thick walls so as to give them great stiffness and prevent substantial distortion of the cross-section of the sound-passage portions extending therethrough under the action of external bending forces when the insert is inserted into the curved space of the outer ear cavity. The ball-like wall sections are interconnected by short neck-like sections to readily flex and take up substantially the entire deformation to which the channel insert is subjected. Thin flexible, skirt-like protrusions project in outward and rearward directions from the ball-like wall sections to become wedged against the surrounding surface portions of the outer ear cavity for automatically establishing therewith an acoustic seal.

U.S. Pat. No. 3,080,011, issued to John D. Henderson, describes an ear canal insert with a very soft tip with mushroom-shaped flanges. A flexible mounting tube is considerably stiffer than the material of which the mushroom-shaped head portion flanges are formed so that it can be used to force the insert portion of the device into the ear canal.

U.S. Pat. No. 5,201,007, issued to Gary L. Ward et al., describes earmolds that convey amplified sound from the hearing-aid to the ear. An acoustic conduction tube extends into the ear canal and a flanged tip on the conduction tube creates a resonant cavity between the tip and the tympanic membrane. The tip is constructed of a flexible material to form a sealed cavity adjacent the tympanic membrane.

Despite numerous attempts including those described above, there remains a need for a mass-produced hearing instrument that is relatively inexpensive, readily adaptable to an individual's atomical and audiological requirements, and that is inconspicuous and lightweight.

Cost is a major consideration in the development of mass-produced hearing instruments. It has been discovered that, of all the components in a hearing instrument, the microphone and receiver (loudspeaker) are generally the most costly. Of these components, the receiver is generally the more costly item. Accordingly, reduction of the cost of the receiver component can significantly lower the cost of manufacturing the hearing instrument. Many receivers are considered to be self contained in that they are mounted within their own metal housing. Generally, such receivers have small solder pads to which electrical connections are made. Such solder connections are sometimes fragile and have been known to break. During manufacturing of hearing instruments with such receivers, great care must be observed so as not to damage the receiver or the solder connections.

Further, cost may also be controlled by ensuring that a sufficient portion of hearing-aids produced function properly. If the manufacturing yield is low, and many hearing-aids fail to meet standards after final assembly, the cost benefits of mass-production may be annulled. Thus, significant savings may be made by designing hearing-aids which facilitate testing at various stages of production. Testing at various stages of production may help to dispose of defective parts before final assembly, thereby increasing the yield.

It has been recognized that the housings for shells used in conventional hearing instruments can become difficult and costly to manufacture. Their shapes are generally dictated primarily by the contours of the ear cavity in which they are intended to be positioned, but attempts to reduce the cost and difficulty of manufacturing conventional shells could reduce the available range of shapes and contours. Alternatively, the cost of manufacturing and the complexity of the manufacturing process remain substantial.

Batteries may serve as a power source for hearing-aids. As described in U.S. patent application Ser. No. 08/815,852, entitled "Disposable Hearing Aid", some hearing-aids have the electronics of the device placed inside the battery chemistry. Because the battery cannot be replaced, the hearing-aid must be discarded when the battery energy is depleted. A target life for such a disposable hearing-aid may be 30 days. Most hearing-aids use replaceable batteries. The replaceable battery may be inserted into the hearing-aid, thereby providing the power source to operate the device.

Replaceable zinc-air batteries are commonly used to power hearing-aids. Prior to use, the battery is sealed with a pull-tab that prevents environmental effects, such as relative humidity and temperature, from affecting the shelf-life of the battery. The pull-tab also prevents air (hence oxygen) from entering the battery. To activate the battery, the pull-tab is removed and air (hence oxygen) is allowed into the battery. The battery is then inserted into the hearing-aid to provide the power source for operating the hearing-aid.

Metal-air cells, such as zinc-air or aluminum-air cells, use air to activate the cell. A typical air cathode may be composed of four primary components:

(1) A carbon matrix formed by activated carbon blended with an aqueous Teflon slurry, washed, dried, and pressed into a current collector; the carbon matrix may include a catalyst, usually a transition metal oxide;

(2) a nickel mesh which provides mechanical strength and serves as the current collector;

(3) a microporous, hydrophobic membrane, typically polytetrafluoroethylene; and (4) an anode/cathode separator which prevents direct contact between the anode and cathode.

Zinc-air cells are activated when air, and in particular oxygen, is allowed to enter the cell. In some zinc-air cells, a pull-tab covers one or more small openings that allow air to reach the air-cathode assembly. The pull-tab may be designed to allow air to diffuse slowly into the cell. With the pull-tab sealing the cell, the cell is oxygen deprived and may not support the same current as an unsealed cell.

SUMMARY OF THE INVENTION

An electronic signal processing system for a hearing instrument includes two connectable sections: a microphone section and a battery section. The microphone section is shaped to enclose a microphone and signal processing circuitry. The bottom of the microphone section includes a plurality of conducting contacts. The battery section includes a casing for engaging the auditory canal and an integral battery. The top of the casing is patterned to electrically connect the integral battery with the plurality of conducting contacts at the bottom of the microphone section.

According to one aspect of the invention, the casing of the battery section has a wall accommodating an anode of the battery and a pair of signal leads. The signal leads extend from the top of the casing of the battery section to the bottom of the casing of the battery section. A receiver section shaped to enclose a receiver may be connected to the bottom of the battery section. The top of the receiver section is patterned to electrically connect the receiver with the pair of signal leads at the bottom of the casing of the battery section.

According to yet another aspect of the invention, a removable tab is positioned between the conducting contacts of the bottom of the microphone section and the top of the casing of the battery section. The removable tab substantially seals a vent in the battery casing. Oxygen is supplied to an electrode of the integral battery through the vent. The tab also prevents electrical contact between the integral battery and the plurality of conducting contacts at the top of the microphone section.

According to another aspect of the invention, a first plurality of conducting strips are formed on a top surface of the removable tab to facilitate testing of the microphone and said signal processing circuitry. A second plurality of conducting strips are formed on a bottom surface of the removable tab to facilitate testing of the integral battery.

According to yet another aspect of the invention, the receiver includes a plurality of receiver components which are mounted directly in the receiver section.

It is understood that the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawings are not to scale. On the contrary, the dimensions of the various features are arbitrarily expanded or reduced for clarity. Included in the drawing are the following figures.

DETAILED DESCRIPTION OF THE INVENTION

Figure 1:
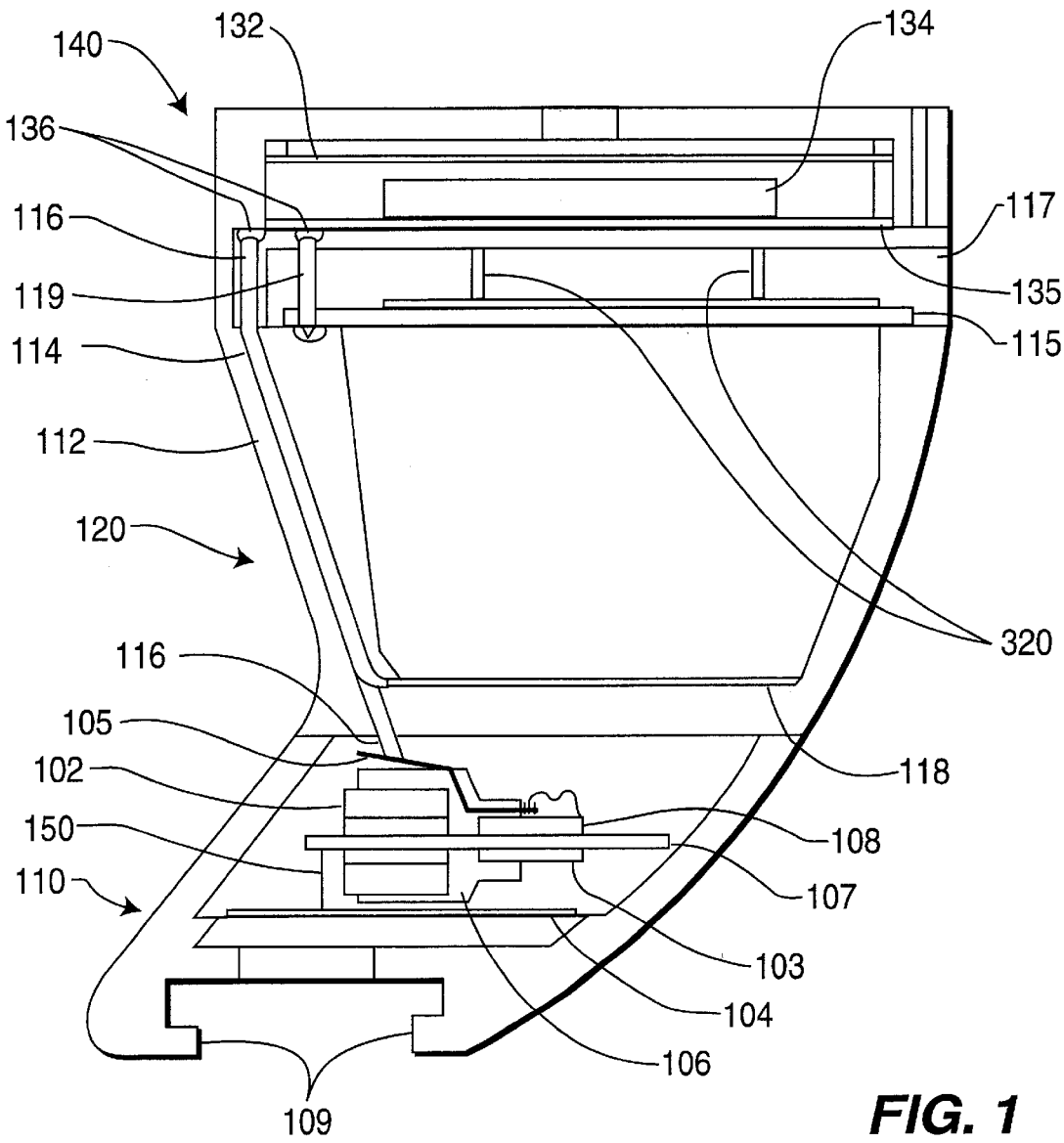
FIG. 1 illustrates a three section hearing-aid arrangement in accordance with an embodiment of the present invention.

A relatively inexpensive hearing-aid may be constructed by integrating microphone, battery and receiver parts into an ear mold body. The ear mold is divided into three distinct sections. FIG. 1 illustrates a three section hearing-aid arrangement: receiver section 110, battery section 120, and microphone section 140. Each of the three sections may be manufactured and tested separately, before the three sections are assembled into a hearing-aid.

The first of three sections, the receiver section, may be positioned closest to the eardrum. Receiver section 110 may be shaped to accommodate receiver parts, such as, permanent magnet 102, armature 103, and flexible contact 105. The parts of a receiver may be held together by plastic anchor 106. Armature 103 may include, for example, coil 108 and ferromagnetic member 107. An electrical signal may be applied to coil 108 of armature 103 via conducting tabs 116 (described below) and flexible contact 105. The application of an electrical signal to coil 108 may effect a change in magnetic flux in ferromagnetic member 107 of armature 103, and hence cause member 107 to vibrate due to the influence of permanent magnet 102. Member 107 of armature 103 may be attached to diaphragm 104 by means of connecting rod 150. Thus, on the application of an electrical signal, diaphragm 104 may vibrate with member 107 of armature 103. The vibration of diaphragm 104 may produce an acoustic signal which is derived from the electrical signal. Diaphragm 104 may have a hole (not shown) for equalizing air pressure.

A receiver contained in receiver section 110 may not require any other special housing, such as housings commonly used for conventional receivers. The receiver part may be tilted at a different angle to reduce feedback. Receiver section 110 itself may serve as a casing for receiver components. In this way, direct access to receiver components may be provided during assembly. Receiver section 110 may be shaped such that when assembled to battery section 120 and microphone section 140, a complete ear mold may be formed. As shown, for example, in FIG. 1, an ear mold constructed by assembling receiver section 110, battery section 120, and microphone section 140 may be shaped to fit and engage the ear canal.

Figure 6:
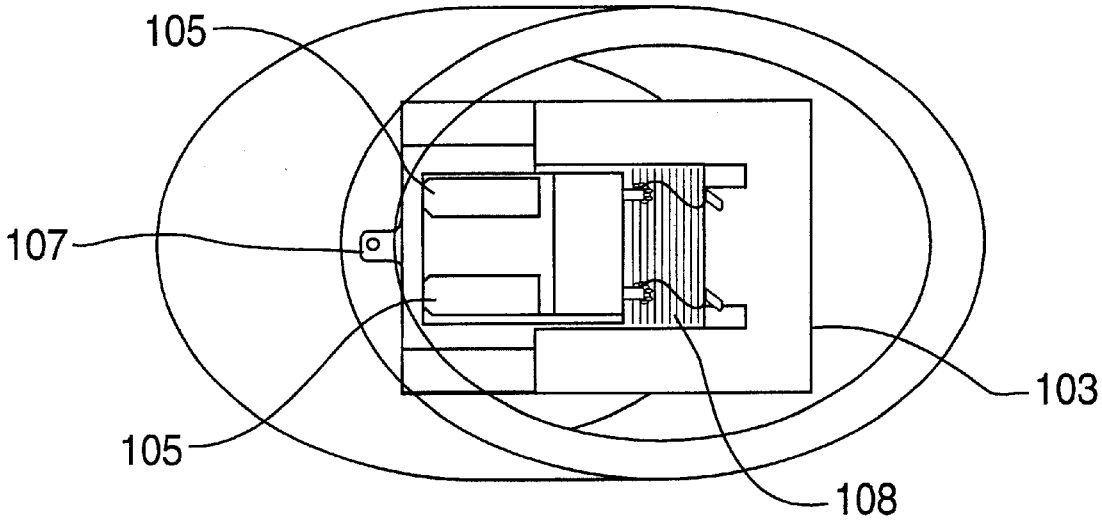
FIG. 6 shows a top view of the receiver section of a hearing-aid of FIG. 7 in accordance with an embodiment of the present invention.
Figure 7:
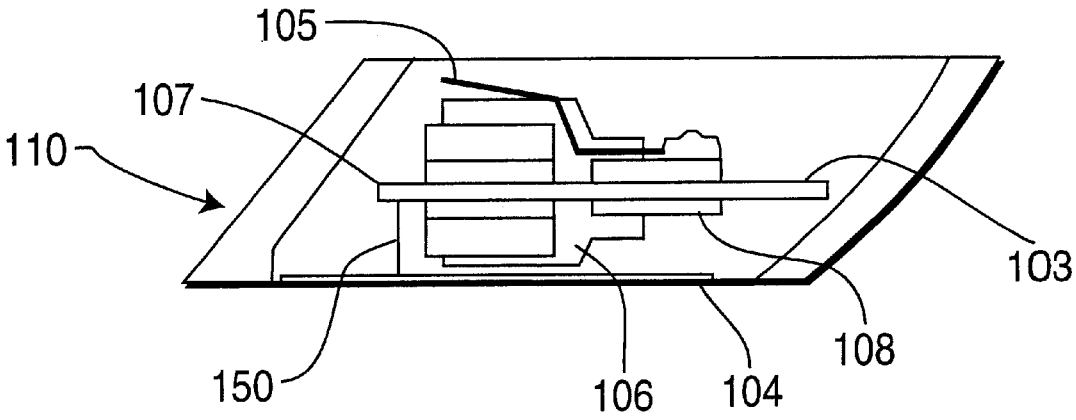
FIG. 7 shows receiver section of a hearing-aid in accordance with an embodiment of the present invention.

Electrical connections with a receiver may be made by aligning conducting tabs entering the top of receiver section 110 from battery section 120 with flexible contact 105. Hence, when receiver section 110 is connected with battery section 120, no soldering may be needed. The end of receiver section 110 opposite battery section 110, may have means 109 to secure an ear tip, such as, for example, a flexible tip (not shown). FIG. 6 shows a top view of receiver section 110 of FIG. 7.

Figure 2:
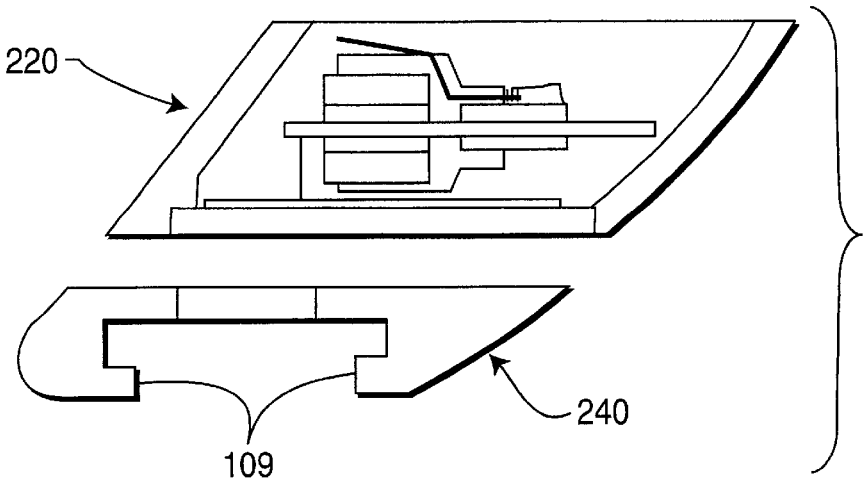
FIG. 2 illustrates an optional two part arrangement for a receiver section in accordance with an embodiment of the present invention.

Optionally, as illustrated in FIG. 2, receiver section 110 may be formed by two separate portions. The receiver section arrangement shown in FIG. 2 may facilitate receiver installation. The receiver may first be installed in first portion 220 of receiver section 110. Armature 103, magnets 102, and plastic anchor 106, may first be installed into one end of first portion 220. The diaphragm may then be attached to the other end of first portion 220. This order of assembly allows more accessibility to delicate parts during assembly and inspection. First portion 220 may then be, for example, bonded to second portion 240 of receiver section 110. Second portion 240 may have means 109 to secure an ear tip (e.g. a flexible tip).

The second section of the hearing-aid is battery section 120. The shape of battery section 120 may approximate the shape of an ear canal when attached (e.g. snapped together and/or bonded) to the other two sections (i.e. receiver section 110 and microphone section 140). Thus, battery section 120 may have an unusual shape which accommodates an integral battery. An integral (sealed-in) battery of this shape (e.g. 9 mm×6 mm) may have a higher capacity battery than those of standard insertable/removable batteries. The battery casing may be formed from a plastic molding which may be, for example, snapped together with and/or solvent sealed to the other sections.

One or more walls of battery section 120, such as, for example, battery wall 112 may be formed sufficiently thick as to insert mold several conductors 114. Conductors 114 may include signal leads, for transmitting electrical signals from microphone 132 and signal processing circuit 134 to the receiver of receiver section 110, as well as battery anode 118. Battery anode 118 may be formed by a conductor of conductors 114 which penetrates through the battery wall and into the battery. Signal leads may terminate with conducting tabs 116 at the top and bottom of the battery casing. Tabs 116 may be made springy. The resiliency of tabs 116 may be helpful in ensuring reliable electrical contact. Battery anode 118 may also terminate in a conducting tab at the top of the battery casing. Tabs 116 may be helpful in making connections with electrical contacts of the other sections. For example, the conducting tabs at the top of battery section 120 may be positioned to meet conducting contacts 136 at the bottom of microphone section 140. Optionally, a vent hole (not shown) may also be provided in battery wall 112 along with conductors 114. The vent hole may vent air from receiver section 110 to microphone section 140 through battery wall 112.

Figure 8:
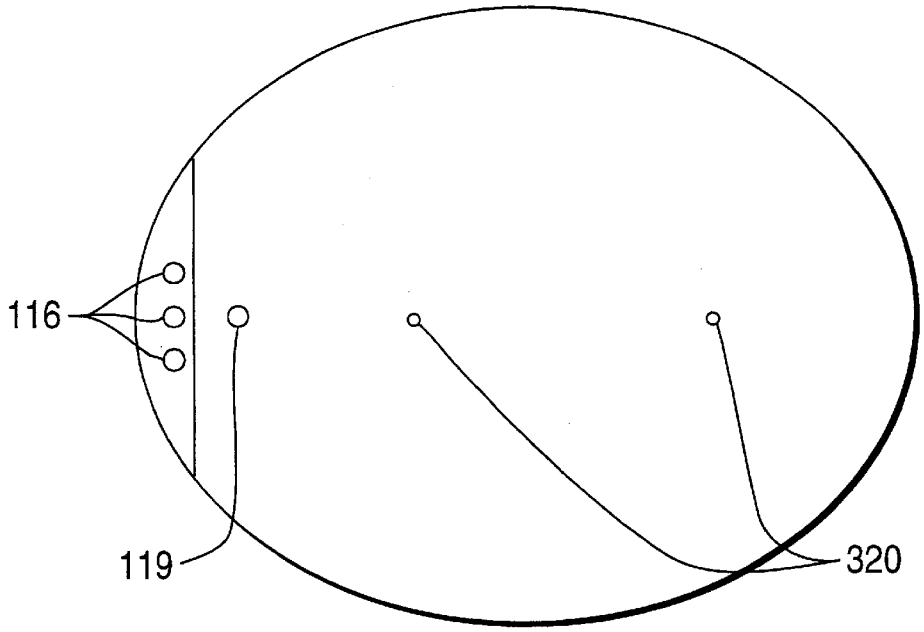
FIG. 8 shows a top view of the battery section of a hearing-aid of FIG. 9 in accordance with an embodiment of the present invention.
Figure 9:
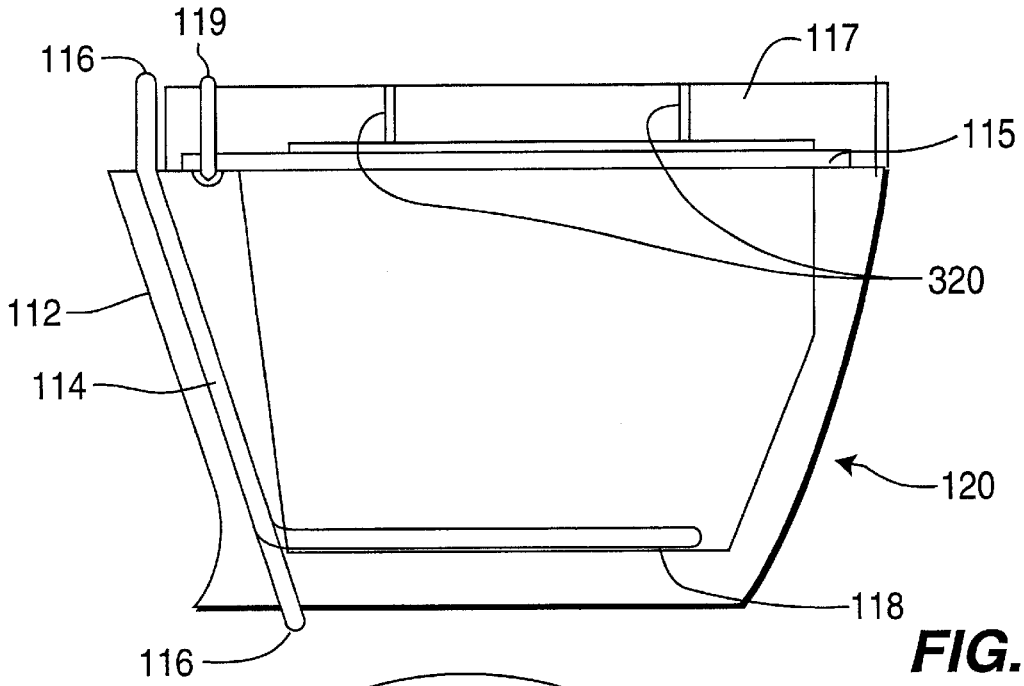
FIG. 9 shows a battery section of a hearing-aid in accordance with an embodiment of the present invention.
Figure 10:
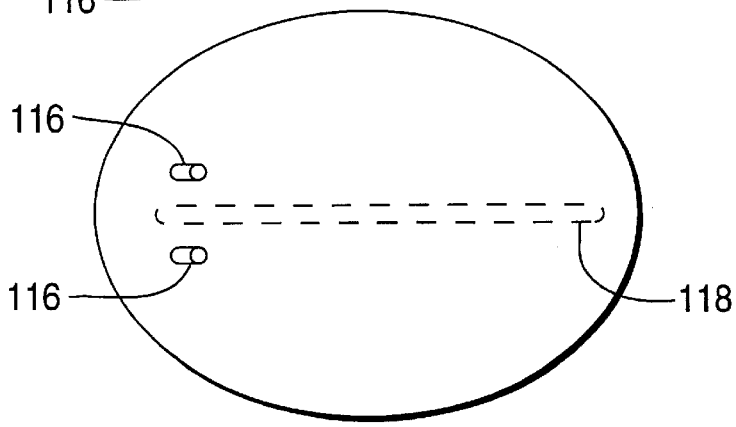
FIG. 10 shows a bottom view of the battery section of a hearing-aid of FIG. 9 in accordance with an embodiment of the present invention.

Battery cathode 115 may be an air-cathode equipped with one or more probes, such as insert-molded probe 119. Insert molded-probe 119 is insert molded into end plate 117. Insert-molded probe 119 may be, for example, inserted in end plate 115 during the final battery seal. Insert-molded probe 119 makes an electrical connection with battery cathode 115 and becomes an external connection to battery cathode 115. Hence, one of conducting contacts 136 at the bottom of microphone section 140 may be positioned to meet with probe 119. Both conducting contacts 136 and insert-molded probe 119 may be made springy to help ensure reliable electrical contact. FIG. 8 shows a top view of battery section 120 of FIG. 9. FIG. 10 shows a bottom view of battery section 120 of FIG. 9.

It has been proposed that if oxygen was completely depleted from the cell, a long shelf-life would be achieved. This hypothesis is based on the assumption that there would be no potential difference to cause current to flow through the load in the absence of oxygen. It may be shown, however, that the voltage of some oxygen deprived zinc-air cells is not zero volts, but approximately 0.39 volts. As a potential difference may be present, a load connected to the cell will cause current to flow, thus discharging the cell.

The chemical reaction associated with an oxygen-enriched zinc-air cell is as follows:

cathodereaction $$\tfrac{1}{2}O_2+H_2O+2e^- \rightarrow 2O\ H^- E^\circ=0.40V$$

anode reaction $$Zn \rightarrow Zn^{2+}+2e^- E^\circ=1.25V$$

$Zn^{2+}+2OH^- \rightarrow Zn(OH)_2$ $Zn(OH)_2 \rightarrow ZnO+H_2O$ overallreaction $Zn+\frac{1}{2}O_2 \rightarrow ZnO$ $E°=1.65V$ When a cell is completely deprived of oxygen, the cell becomes a zinc-hydroxide cell, wherein the cathode material is hydroxide taken from the electrolyte. The chemical reaction associated with the zinc-hydroxide cell is as follows:

cathode reaction $2H_2O+2e^- \rightarrow H_2+2OH^-E°=0.828V$ anode reaction $Zn+4OH^- \rightarrow ZnO_2^{-2}+2H_2O+2e^-E°=1.21V$ overall reaction $Zn+2OH^-ZnO_2^{-2}+H_2E°=0.388V$ Battery section 120 may thus be tested, in the oxygen deprived state, before being assembled into a hearing-aid by adjoining receiver section 110 to the bottom, and microphone section 140 to the top of battery section 120. For example, in the oxygen deprived state a small voltage (e.g. 0.39 volts) may be detected. In the presence of an air leak, however, a voltage which is larger than the small voltage expected in the oxygen deprived state will be detected.

In addition, a thirty day leakage check may be made to determine if the sealed battery is intact. In the event that an electrolyte leak is detected, the unassembled battery may be discarded. As a leak may be detected, however, before assembly, battery defects (e.g. a leak) may not damage other hearing-aid components. Hence, a fault detected in the battery will not affect the other components, thereby increasing the yield.

Figure 3:
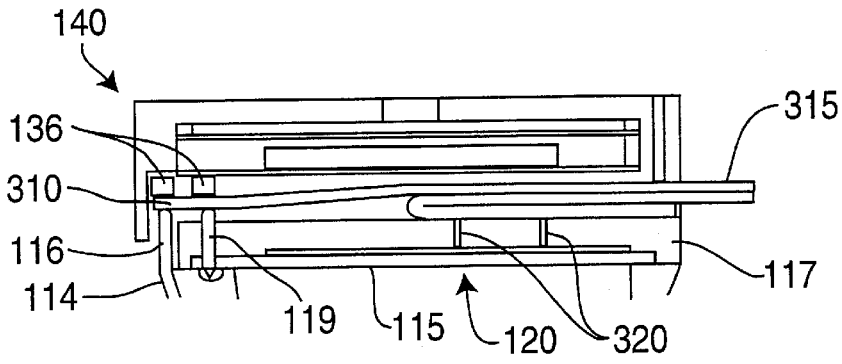
FIG. 3 Shows a microphone section and the top of a battery section with a "pull" tab.

Further, as shown in FIG. 3, once battery section 120 is manufactured, tab 310 may be placed over vents 320 to block oxygen from reaching battery cathode 115. "pull" portion 315 of tab 310 may extend outside a hearing-aid. Another portion of tab 310 may be made sticky. Sticky portion of tab 310 may adhere to the top of, and substantially seal, vents 320. An additional portion of tab 310, which is not sticky, may extend beyond vents 320. The portion of tab 310 extending beyond vents 320 may be used to prevent electrical connection between battery section 120 and other electronic circuits of the hearing-aid. In other words, when the hearing-aid is assembled a portion of tab 310 may be positioned as to electrically separate conducting contacts 136 at the bottom of microphone section 140 and the battery cathode 115, and conductors 114. Therefore, tab 310 is helpful in preventing the dissipation of the sealed battery of battery section 120 during the self-life of the assembled hearing-aid device.

Figure 4:
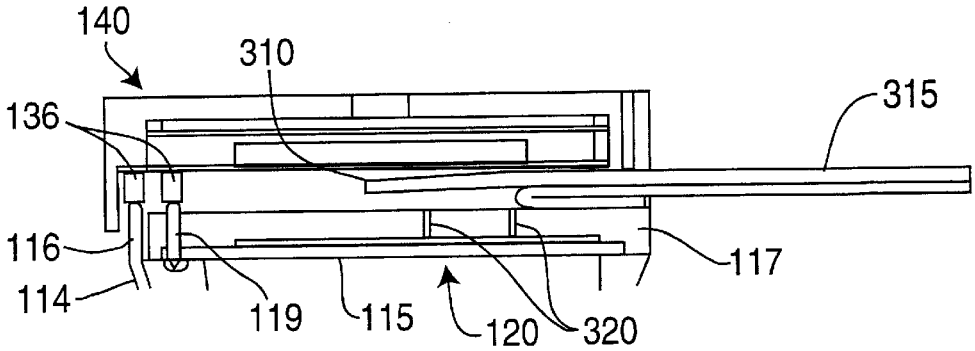
FIG. 4 Shows a microphone section and the top of a battery section with a "pull" tab in an intermediate position.

"pull" section 315 may be fashioned to allow a user to grasp and tug on portion 315, permitting the user to remove (pull out) tab 310 thereby activating both electronic circuits and integral battery. FIG. 4 illustrates an intermediate position of tab 310. In the intermediate position shown in FIG. 4, tab 310 has been "pulled back" to allow electrical contact between conducting contacts 136 and battery cathode 115 via insert-molded probe 119, and between conducting contacts 136 and conductors 114 via conducting tabs 116. Further, as shown in FIG. 4, tab 310 has been "pulled back" to uncover vents 320. If the non-sticky portion of tab 310 was not used, the sticky portion of tab 310 would stick to 140 making it difficult to pull portion 315. The non-stcky portion of tab 310 covers the sticky portion when 315 is pulled.

It may be desirable to form conductive strips on both top and bottom surfaces of the "non-sticky" (insulating) portion of tab 310. Each conductive strip may extend along tab 310 and outside of a hearing-aid. Thus, each conductive strip may terminate along "pull" portion 315. Each of the conductive strips may be positioned to mate, respectively, with each of the conducting contacts 136 at the bottom of microphone section 140, as well as with battery cathode 115 (via insert-molded probe 119), and conductors 114 including battery anode 118, (via conducting tabs 116) at the top battery section 120. Nevertheless, these conductive strips may be arranged in such a way as to prevent electrical contact between any pair of strips. In this way, both the integral battery and other circuit components may be tested at any time without removing (pulling out) tab 310 and without substantially reducing the self-life of a hearing-aid device. For example, battery section 120 may be tested for current flow in the oxygen deprived state.

Figure 5:
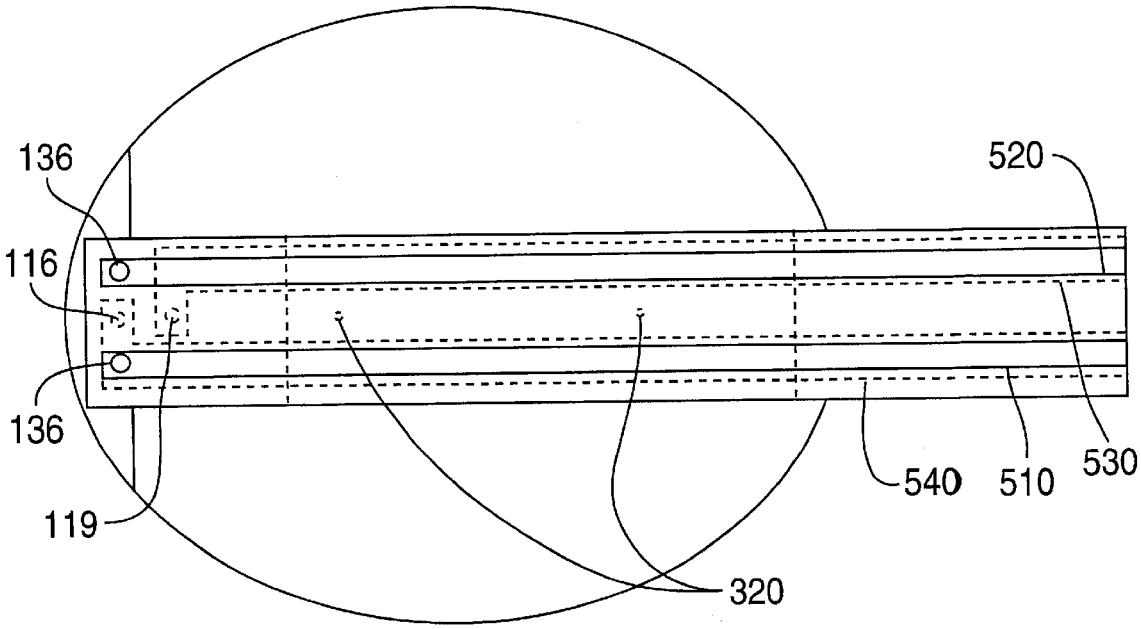
FIG. 5 shows a top view of a battery section with a tab which has conducting strips on both a top and bottom surface in accordance with an embodiment of the present invention.

For example, FIG. 5 shows a top view of battery section 120 with tab 310. Tab 310 is shown with conductive strips formed on both top and bottom surfaces of tab 310. Conductive strips 510 and 520 are formed on a top surface of the tab 310, while conductive strips 530 and 540 are formed on a bottom surface of tab 310. Conductive strips 510 and 520 may be positioned to mate with two of conducting contacts 136 corresponding to a signal line of signal processing circuit 134. Further, conductive strips 530 and 540 may be positioned to mate, respectively, with battery cathode 115 (via insert-molded probe 119), and battery anode 118 (via conducting tabs 116) at the top of battery section 120. Optionally, the geometry of these conductive strips may be rearranged to accommodate, for example, additional strips (not shown) on a bottom surface of tab 310 to mate, respectively, with two conducting tabs 116. Additional strips on a bottom surface of tab 310 may facilitate external (electrical) access to test receiver section 110.

Figure 11:
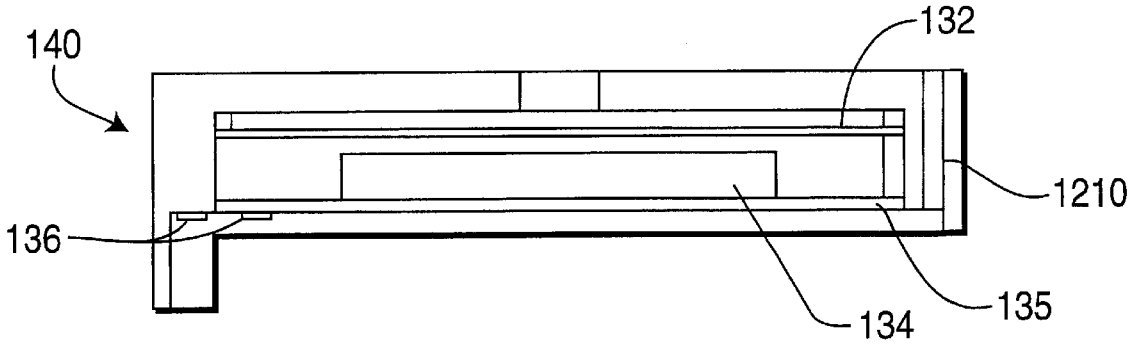
FIG. 11 shows a microphone section of a hearing-aid in accordance with an embodiment of the present invention.
Figure 12:
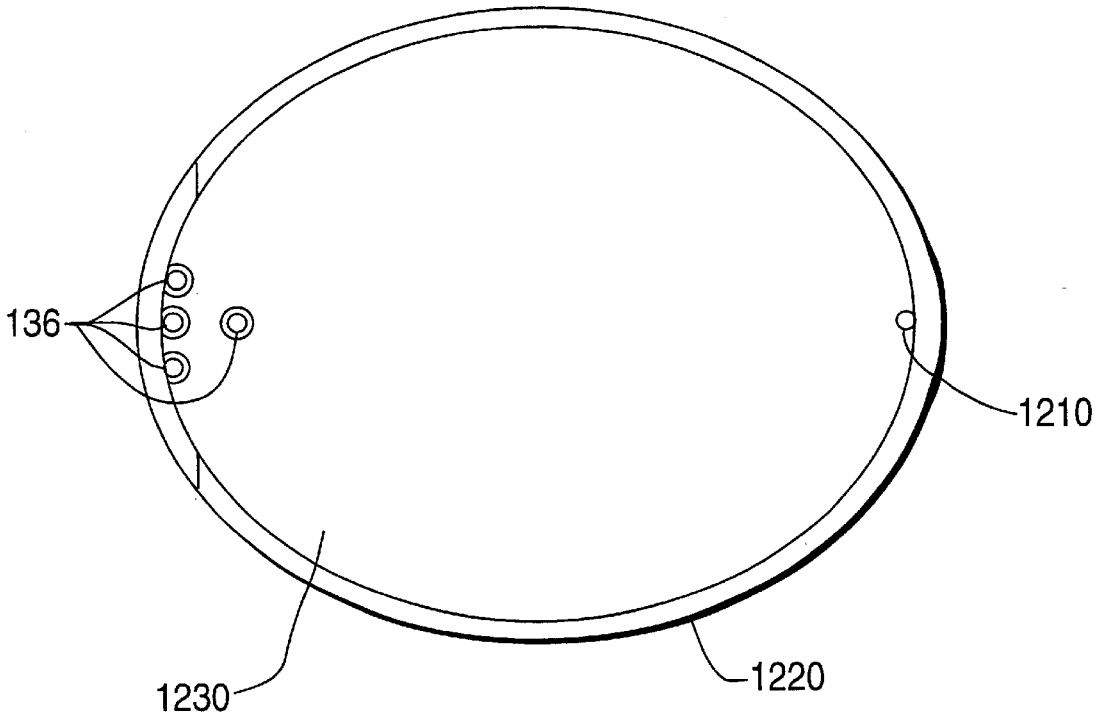
FIG. 12 shows a bottom view of the microphone section of a hearing-aid of FIG. 11 in accordance with an embodiment of the present invention.

The third section of the hearing-aid, shown in FIG. 1, is microphone section 140. Microphone section 140 may be shaped to accommodate microphone 132 as well as signal processing circuit 134. Microphone 132 may be, for example, an electret microphone. Signal processing circuit 134 may be implemented, for example, by an integrated circuit which is mounted on circuit board 135. The bottom of microphone section 140, facing battery section 120 may be formed by a circuit board having conducting contact pads 136. Conducting contact pads 136 may mate with the contacts 114 molded into a battery wall. FIG. 12 shows a bottom view of microphone section 140 shown in FIG. 11. FIG. 12 shows conducting contacts 136, battery vent 1210, as well as housing 1220, and ground plane 1230 covering the lower surface of circuit board 135. Housing 1220 may be, for example, made from plastic.

Figure 13:
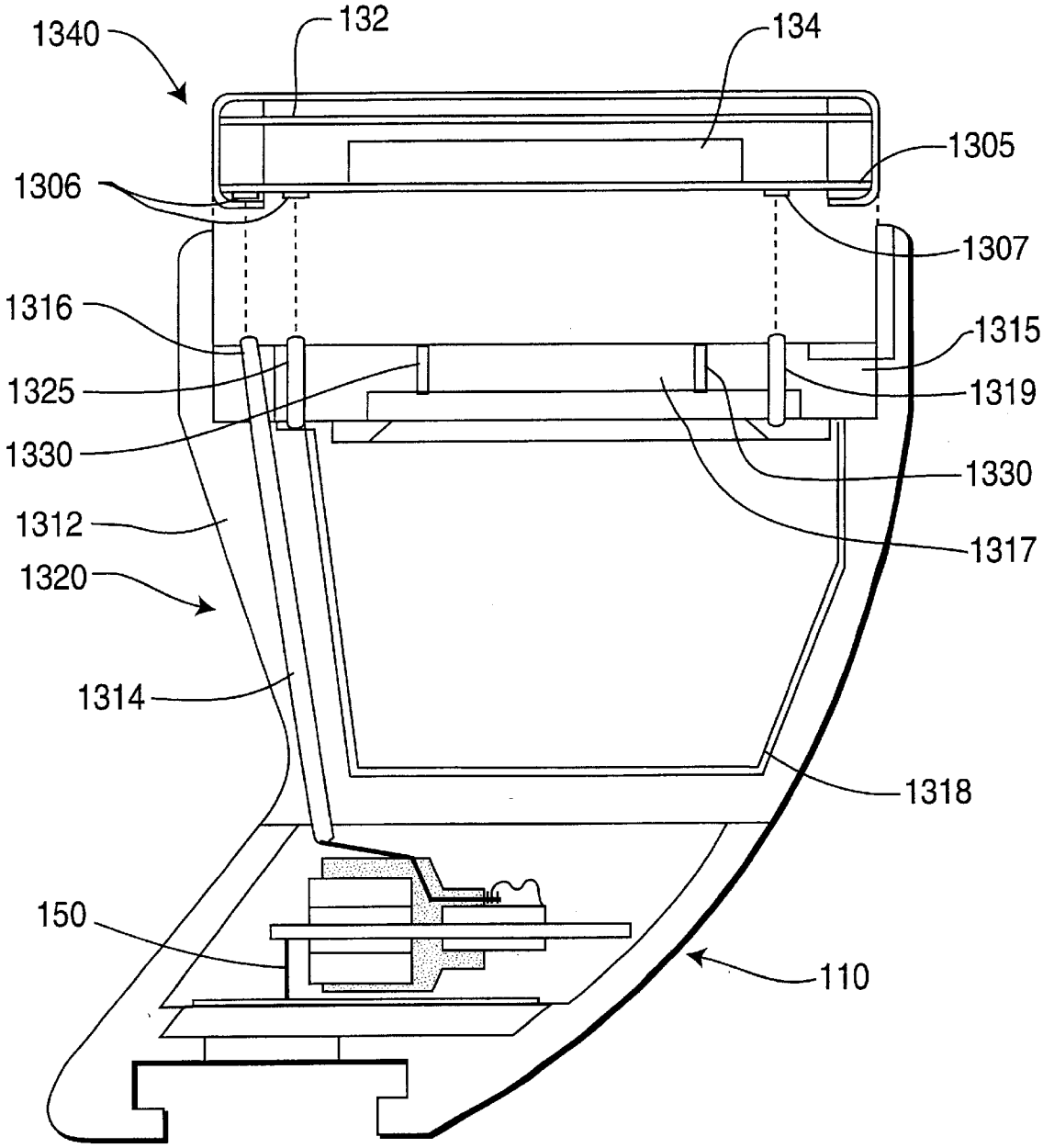
FIG. 13 illustrates a three section hearing-aid arrangement in accordance with an embodiment of the present invention.

FIG. 13 illustrates a three section hearing-aid arrangement in an alternative to the arrangement of FIG. 1. The hearing-aid of FIG. 13 includes: receiver section 110, battery section 1320, and microphone section 1340. Receiver section 110 shown in FIG. 13 may be identical to the receiver section of FIG. 1.

The shape of battery section 1320 may approximate the shape of an ear canal when attached (e.g. snapped together and/or bonded) to the other two sections (i.e. receiver section 110 and microphone section 1340). The battery casing may be formed from a plastic molding which may be, for example, snapped together with and/or solvent sealed to the other sections. The seams sealing an upper portion of battery section (i.e. sealing the integral battery) may be left completely out of the ear canal. In this way, in case of battery failure and leakage, spillage of battery materials typically will not flow into a user's ear canal.

One or more walls of battery section 1320, such as, for example, battery wall 1312 may be formed to be sufficiently thick as to insert-mold several conductors 1314. Conductors 1314 may include signal leads, for transmitting electrical signals from microphone 132 and signal processing circuit 134 to a receiver. Signal leads may terminate with conducting tabs 1316 at the top and bottom of the battery casing. Battery anode 1318 may be formed by a conducting cup lining an interior surface of battery section 1320. Battery anode 1318 may also terminate in conducting tab 1325 at the top of the battery casing. Tabs 1316 and 1325 may be made springy and may be helpful in making reliable connections with electrical contacts of the other sections. For example, the conducting tabs at the top of battery section 1320 may be positioned to meet conducting contacts 1306 at the bottom of microphone section 1340.

Battery cathode 1317 may be an air-cathode equipped with a probe, such as insert-molded probe 1319. Insert-molded probe 1319 may be, for example, inserted in end plate 1315. Insert-molded probe 1319 makes an electrical connection with battery cathode 1317 and becomes an external connection to battery cathode 1317 during the final battery seal. Hence, one of conducting contacts 1307 at the bottom of microphone section 1340 may be positioned to meet with probe 1319. Vents 1330 may be provided in the housing of battery section 1320 to supply oxygen to battery cathode 1317. Note that conducting contacts 1306 and 1307 as well as insert-molded probe 1319 may be made springy to help ensure reliable electrical contact.

Figure 14:
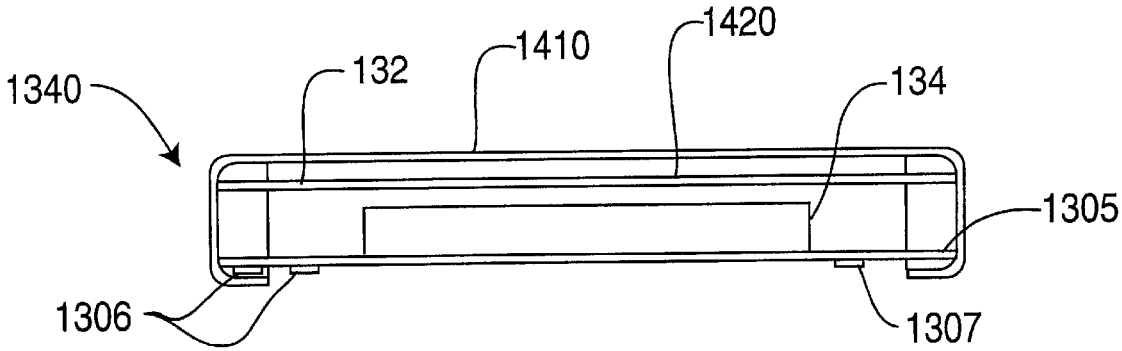
FIG. 14 shows a microphone section of a hearing-aid in accordance with an embodiment of the present invention.
Figure 15:
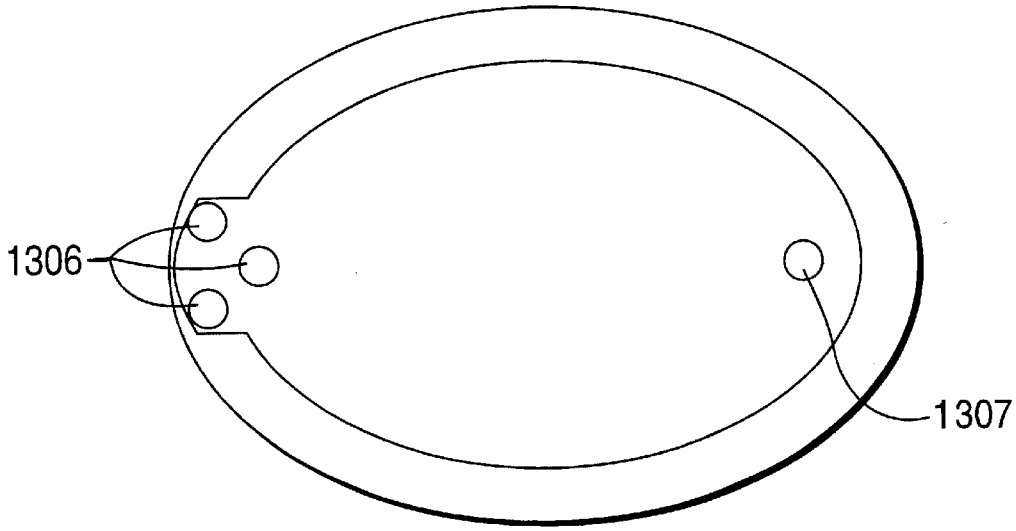
FIG. 15 shows a bottom view of the microphone section of a hearing-aid of FIG. 14 in accordance with an embodiment of the present invention.

Microphone section 1340 is shown in FIG. 14. Microphone section 1340 may be encased in metallic case 1410 to shield circuit 134. A ground plane may be added to the circuit board to further shield the circuit. Microphone section 1340 may be shaped to accommodate microphone 132 as well as signal processing circuit 134. Signal processing circuitry 134 may be implemented, for example, by an integrated circuit which is mounted on circuit board 1305. The bottom of microphone section 1340, facing battery section 1320 may be formed by a circuit board having conducting contact pads 1306 and 1307. Conducting contact pads 1306 may mate with tabs 1316 and 1325 at one end of circuit board 1305, and contact pad 1307 may mate with insert-molded probe 1319 at another end of circuit board 1305.

In an alternative to the above described embodiments of the present invention, a microphone section of a hearing-aid (e.g. microphone section 140 of FIG. 11) may be made to rotate on a face of a battery section (e.g. battery section 120). A microphone section rotating on the face of an integral battery may permit different signal processing functions of signal processing circuit 134 to be engaged. In other words, depending on an indexed position of a rotating microphone section different audio modes of a signal processing system for a hearing instrument may be engaged. For example, an audio mode (audio format) may be chosen to amplify one set of frequencies and/or attenuate another set of frequencies. An audio mode may be selected, for example, to emphasize medium and high audio frequencies.

Figure 16:
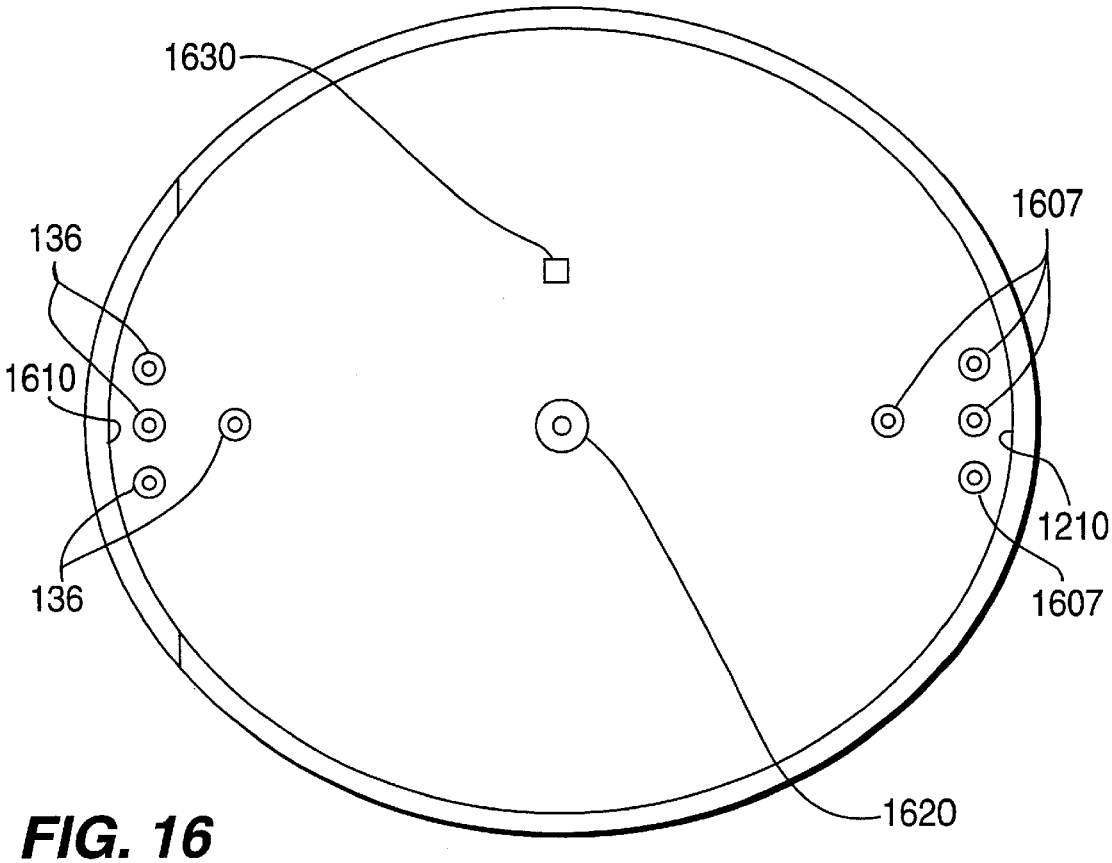
FIG. 16 shows a bottom view of a rotating microphone section of a hearing-aid in accordance with an embodiment of the present invention.
Figure 17:
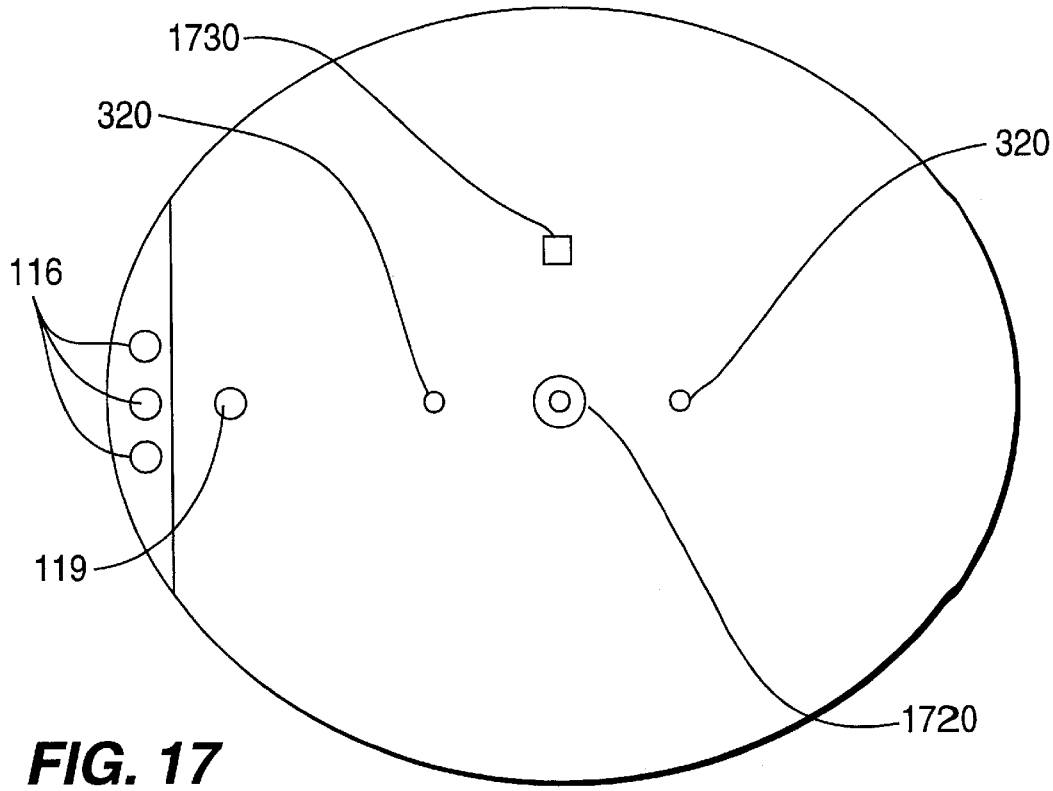
FIG. 17 shows a top view of a battery section of a hearing-aid in accordance with an embodiment of the present invention.

FIG. 16 shows a bottom view of a microphone section having two indexed positions. The bottom view of FIG. 16 also shows two vents 1610 and 1210. Each of the indexed positions corresponds to a different audio mode or profile. In one position, conducting contacts 136 on a first side of a microphone section may engage conducting tabs 116 of battery section 120. In a second position, conducting contacts 1607 on a second side of the microphone section may engage conducting tabs 116 of battery section 120. Hence, as illustrated for example in FIG. 16, microphone section 140 may be rotated 180° about pivot element 1620 in order to shift between audio modes. An indexing contact (or switch) 1630 may be provided in circuit board 135 to detect the position of a microphone section. Indexing contact (or switch) 1630 may be disposed to mate with a complementary indexing contact (or bump) disposed at the top of battery section 120. A complementary indexing contact (or bump) may mate with indexing contact (or switch) 1630 in a first position of microphone section 140 but not in a second position. Therefore, the position of a rotating microphone section may be detected, and the corresponding audio mode set by the signal processing circuitry. FIG. 17 shows a top view of a battery section having pivot point 1720, and complementary indexing contact (or bump) 1730.

Additional modifications are contemplated and the substitution of components for equivalent components and features is intended to be within the scope of the invention as it is defined in the appended claims.

What is claimed is:

1. An electronic signal processing system for a hearing instrument comprising:

a microphone section, having a bottom, shaped to enclose a microphone and signal processing circuitry, the bottom of the microphone section having a plurality of conducting contacts;

a battery section, connectable to said microphone section, including a casing for engaging the auditory canal and an integral battery, the casing having a vent through which oxygen is supplied to an electrode of the integral battery; and a removable tab positioned between the conducting contacts of the bottom of the microphone section and the top of the casing of the battery section, the removable tab substantially sealing the vent and preventing electrical contact between the integral battery and the plurality of conducting contacts.

2. The electronic signal processing system of claim 1, wherein the removable tab includes an adhesive portion for securing the removable tab to the vent.

3. The electronic signal processing system of claim 1, wherein a first plurality of conducting strips are formed on a top surface of the removable tab to facilitate testing of the microphone and said signal processing circuitry, and a second plurality of conducting strips are formed on a bottom surface of the removable tab to facilitate testing of the integral battery.

* * * * *